US006382774B1

(12) United States Patent
Izumi

(10) Patent No.: US 6,382,774 B1
(45) Date of Patent: May 7, 2002

(54) PRINTER HAVING ENERGIZING PULSE WIDTH CALCULATING MEANS

(75) Inventor: Shigeo Izumi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/456,620

(22) Filed: Dec. 8, 1999

(30) Foreign Application Priority Data

Dec. 21, 1998 (JP) ..... 10-363226

(51) Int. Cl.[7] ..... B41J 2/05
(52) U.S. Cl. ..... 347/61; 347/192
(58) Field of Search ..... 347/61, 56, 54, 347/20, 1, 23, 58, 59, 64, 67, 17, 19, 192, 190, 191, 189; 374/141; 320/106; B41J 2/37

(56) References Cited

U.S. PATENT DOCUMENTS 4,409,600 A * 10/1983 Minowa ..... 347/211
4,494,126 A * 1/1985 Todoh ..... 347/189
4,510,505 A * 4/1985 Fukui ..... 347/190
4,577,203 A * 3/1986 Kawamura ..... 347/30
4,607,262 A * 8/1986 Moriguchi et al. ..... 347/169
5,087,923 A * 2/1992 Bruch ..... 347/191
5,365,257 A * 11/1994 Minowa et al. ..... 347/189
5,694,019 A * 12/1997 Uchida et al. ..... 320/106
5,845,144 A * 12/1998 Tateyama et al. ..... 712/1

* cited by examiner

*Primary Examiner*—N. Le
*Assistant Examiner*—K. Feggins
(74) *Attorney, Agent, or Firm*—Adams & Wilks

(57) ABSTRACT

A thermal printer is provided in which unevenness of printing due to temperature changes of a power source, can be prevented from occurring as well as prevented useless power consumption with a simple configuration. The temperature of a cell is measured with a cell temperature measuring section, and by referring to a table showing a relationship between the temperature and the internal resistance of the cell, which is stored in ROM, corresponding resistance is acquired. An energizing pulse width for energizing each heater element of a thermal head is calculated while the above-mentioned resistance is taking into consideration, to thereby energize and drive the above each heater element.

15 Claims, 5 Drawing Sheets

FIG.5

| Cell temperature (℃) | Internal resistance (Ω) | Cell temperature (℃) | Internal resistance (Ω) | Cell temperature (℃) | Internal resistance (Ω) |
|---|---|---|---|---|---|
| 49.7 | 0.292016 | 33.0 | 0.397876 | 15.5 | 0.573332 |
| 49.3 | 0.294983 | 32.6 | 0.400760 | 15.0 | 0.580421 |
| 48.8 | 0.297904 | 32.2 | 0.403683 | 14.5 | 0.587729 |
| 48.4 | 0.300782 | 31.8 | 0.406649 | 14.0 | 0.595266 |
| 48.0 | 0.303619 | 31.4 | 0.409660 | 13.5 | 0.603042 |
| 47.5 | 0.306417 | 31.0 | 0.412718 | 13.0 | 0.611068 |
| 47.1 | 0.309181 | 30.5 | 0.415826 | 12.5 | 0.619355 |
| 46.7 | 0.311911 | 30.1 | 0.418985 | 12.0 | 0.627917 |
| 46.3 | 0.314611 | 29.7 | 0.422199 | 11.4 | 0.636767 |
| 45.8 | 0.317283 | 29.3 | 0.425469 | 10.9 | 0.645918 |
| 45.4 | 0.319929 | 28.9 | 0.428799 | 10.4 | 0.655386 |
| 45.0 | 0.322552 | 28.5 | 0.432191 | 9.8 | 0.665187 |
| 44.6 | 0.325154 | 28.0 | 0.435648 | 9.3 | 0.675337 |
| 44.2 | 0.327737 | 27.6 | 0.439172 | 8.7 | 0.685856 |
| 43.7 | 0.330303 | 27.2 | 0.442767 | 8.2 | 0.696763 |
| 43.3 | 0.332855 | 26.8 | 0.446435 | 7.6 | 0.708080 |
| 42.9 | 0.335394 | 26.3 | 0.450180 | 7.0 | 0.719828 |
| 42.5 | 0.337923 | 25.9 | 0.454005 | 6.4 | 0.732033 |
| 42.1 | 0.340444 | 25.5 | 0.457912 | 5.8 | 0.744720 |
| 41.7 | 0.342959 | 25.1 | 0.461906 | 5.2 | 0.757920 |
| 41.2 | 0.345470 | 24.6 | 0.465990 | 4.6 | 0.771662 |
| 40.8 | 0.347979 | 24.2 | 0.470167 | 4.0 | 0.785980 |
| 40.4 | 0.350487 | 23.8 | 0.474441 | 3.3 | 0.800911 |
| 40.0 | 0.352998 | 23.3 | 0.478817 | 2.7 | 0.816494 |
| 39.6 | 0.355512 | 22.9 | 0.483297 | 2.0 | 0.932774 |
| 39.2 | 0.358033 | 22.4 | 0.487887 | 1.3 | 0.849797 |
| 38.8 | 0.360561 | 22.0 | 0.492590 | 0.7 | 0.867617 |
| 38.4 | 0.363098 | 21.6 | 0.497411 | 0.0 | 0.886290 |
| 37.9 | 0.365648 | 21.1 | 0.502356 | −0.8 | 0.905881 |
| 37.5 | 0.368211 | 20.7 | 0.507428 | −1.5 | 0.926459 |
| 37.1 | 0.370790 | 20.2 | 0.512634 | −2.3 | 0.948104 |
| 36.7 | 0.373386 | 19.7 | 0.517978 | −3.0 | 0.970902 |
| 36.3 | 0.376002 | 19.3 | 0.523466 | −3.8 | 0.994950 |
| 35.9 | 0.378640 | 18.8 | 0.529104 | −4.6 | 1.020358 |
| 35.5 | 0.381301 | 18.4 | 0.534898 | −5.5 | 1.047251 |
| 35.1 | 0.383988 | 17.9 | 0.540855 | −6.3 | 1.075766 |
| 34.7 | 0.386702 | 17.4 | 0.546981 | −7.2 | 1.106065 |
| 34.3 | 0.389446 | 16.9 | 0.553285 | −8.1 | 1.138329 |
| 33.8 | 0.392221 | 16.5 | 0.559772 | −9.1 | 1.172767 |
| 33.4 | 0.395031 | 16.0 | 0.566452 | −10.0 | 1.209624 |

PRINTER HAVING ENERGIZING PULSE WIDTH CALCULATING MEANS

BACKGROUND OF THE INVENTION

1. Field of the Invention

The present invention relates to a thermal printer for printing characters etc., and more particularly, to a thermal printer that uses a power source such as a cell in which at least its internal resistance varies due to a temperature change.

2. Description of the Related Art

Heretofore, such a thermal printer has been used for printing characters etc., and is provided with a plurality of heater elements arranged in a thermal head for effecting a print operation by thermic color development or thermal transfer by supplying an energizing pulse signal in accordance with a print signal to the heater element.

In a thermal printer that uses a cell as a power source, a voltage drop is caused upon printing due to internal resistance of the cell when driving the thermal printer. Therefore, the above each heater element cannot be driven with a proper energy, and unevenness in the density of printing etc. may be caused.

To solve the above-mentioned problem, the conventional thermal printer is provided with a dummy load generating circuit. Accordingly, when the thermal printer is powered on, current is supplied to the cell by using the above dummy load generating circuit, and the internal resistance of the cell is calculated by detecting its voltage drop, and in consideration of the internal resistance, an energizing pulse width for driving each heater element is calculated as disclosed in Japanese Patent Application Laid-open No. Hei 6-115143.

In the above-mentioned conventional thermal printer, a dummy load circuit for calculating the internal resistance of a cell is required. Therefore, there arise problems in that with the complication of the configuration thereof, the price of the printer becomes high, and useless power is consumed in the dummy load circuit.

Further, since the calculation of the internal resistance is only carried out when power is turned on, change in the internal resistance due to temperature changes of a cell during printing is not taken into consideration. As a result, there occurs a case where energy for driving a heater element is not a proper value, which causes a problem in that the unevenness of printing density is generated.

In addition, other than the case where a cell is used, if a power source is used in which the internal resistance varies due to temperature changes, a similar problem occurs.

SUMMARY OF THE INVENTION

In view of the above-mentioned problems, the present invention has been made, and an object of the invention is to provide a printer in which unevenness of printing quality due to temperature changes of a power source can be prevented from occurring as well as can be prevented the useless power consumption of a dummy load with a simple configuration.

According to the present invention, there is provided a thermal printer, which is driven at least by a power supply in which the internal resistance varies depending upon a temperature, and is provided with a plurality of heater elements arranged in a thermal head for effecting a print operation by supplying an energizing pulse in accordance with a print signal applied to the heater element, characterized by comprising: power supply temperature measuring means for measuring a temperature of the power supply; storage means for storing a table showing a relationship between the temperature and the internal resistance of the power supply; and pulse width calculating means for acquiring, by referring to a table stored in ROM, a corresponding resistance on the basis of the temperature measured by the temperature measuring means, and for calculating a pulse width of an energizing pulse while the resistance is taken into consideration.

The pulse width calculating means acquires the corresponding resistance based upon the temperature measured by the temperature measuring means, by referring to a table stored in the storage means and calculates the pulse width of an energizing pulse for driving each heater element while taking the acquired resistance into consideration.

A cell can be used for the above power source.

Further, according to the present invention, a configuration may be employed in which a thermal printer further comprises power supply discriminating means that is driven by switching the cell and a DC power supply, acquired from an AC power supply, for discriminating by which of the cell or the DC power supply acquired from the AC power supply the thermal printer is driven, wherein the pulse width calculating means calculates the pulse width of the energizing pulse by referring to the table when the power supply discriminating means judges that the thermal printer is driven by the cell.

Further, a thermal printer according to the present invention may be configured such that the pulse width calculating means sets the resistance to a given fixed value, and calculates the pulse width of the energizing pulse when the power supply discriminating means judges that the thermal printer is driven by a DC power supply acquired from an AC power supply.

Furthermore, a thermal printer according to the present invention may be configured such that the pulse width calculating means calculates the pulse every time one line is printed.

BRIEF DESCRIPTION OF THE DRAWINGS

In the accompanying drawings:

FIG. 5 shows a table used for the embodiment of the present invention.

DETAILED DESCRIPTION OF THE PREFERRED EMBODIMENTS

Figure 1:
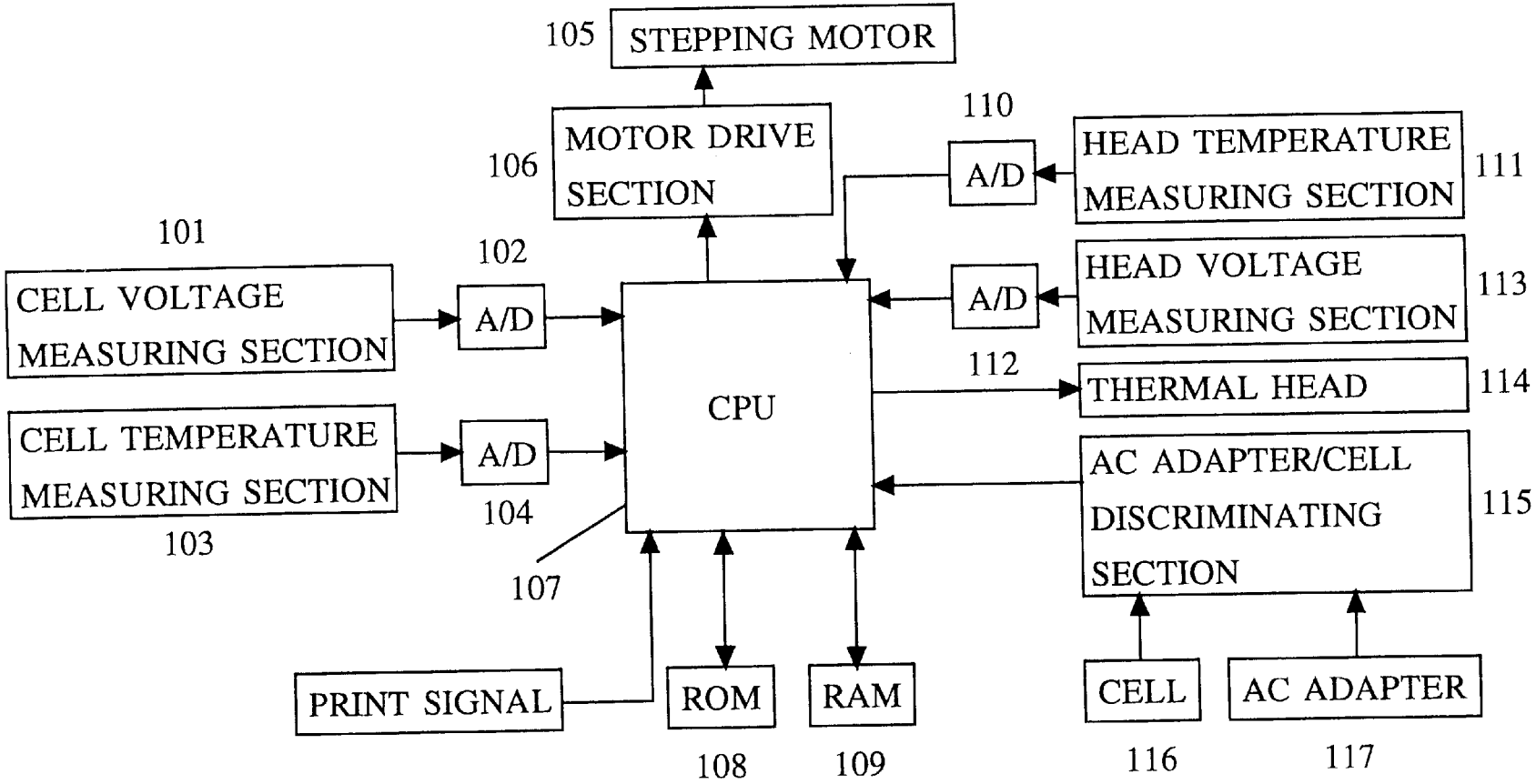
FIG. 1 is a block diagram showing a thermal printer according to an embodiment of the present invention.

FIG. 1 is a block diagram showing a thermal printer according to an embodiment of the present invention. As shown in FIG. 1, a cell voltage measuring section 101 as power supply voltage measuring means for measuring the voltage of a cell 116 as a power supply, and a cell temperature measuring section 103 as power supply temperature measuring means is provided for measuring the temperature of the cell 116. The cell voltage measuring section 101 and the cell temperature measuring section 103 are respectively connected to a central processing unit (CPU) 107 constituting pulse width calculating means through an analog-to-digital (A/D) converting circuit 102 for converting an analog signal sent from the cell voltage measuring section 101, which corresponds to the voltage of the cell 116, into a digital signal to output the same and an A/D converting circuit 104 for converting an analog signal sent from the cell temperature measuring section 103, which corresponds to the temperature of the cell 116, into a digital signal to output the same.

A print signal such as print data is input into the CPU 107, and a read only memory (ROM) :108 serves as storage means for storing a processing program of the CPU 107, a random access memory (RAM) 109 is provided for storing print data etc., a thermal head 114 including a plurality of heater elements (for example, 64), which is driven by an energizing pulse from the CPU 107 is provided to conduct a print on print paper (not shown), and an AC adapter/cell discriminating section 115 serving as power supply discriminating means is provided for discriminating which of the cell 116 or an AC adapter 117 is connected thereto, all of which are connected to the CPU 107.

Also, a head temperature measuring section 111 for measuring the temperature of the thermal head 114 and a head voltage measuring section 113 for measuring the voltage of an energizing pulse supplied to the thermal head 114, are respectively connected to the CPU 107 via an A/D converting circuit 110 for converting an analog signal sent from the head temperature measuring section 111, which corresponds to the temperature of the thermal head 114, into a digital signal to output the same, and an A/D converting circuit 112 for converting an analog signal sent from the head voltage measuring section 113, which corresponds to the voltage of an energizing pulse to the thermal head 11, into a digital signal to output the same.

Further, the CPU 107 is connected to a stepping motor 105 via a motor drive section 106. The stepping motor 105 controls the movement of the thermal head 114 and a paper feed mechanism (not shown) in the case that the thermal head 114 is movable, and controls only a paper feed mechanism without controlling the movement of the thermal head 114 in the case that the thermal head 114 is fixed.

Figure 2:
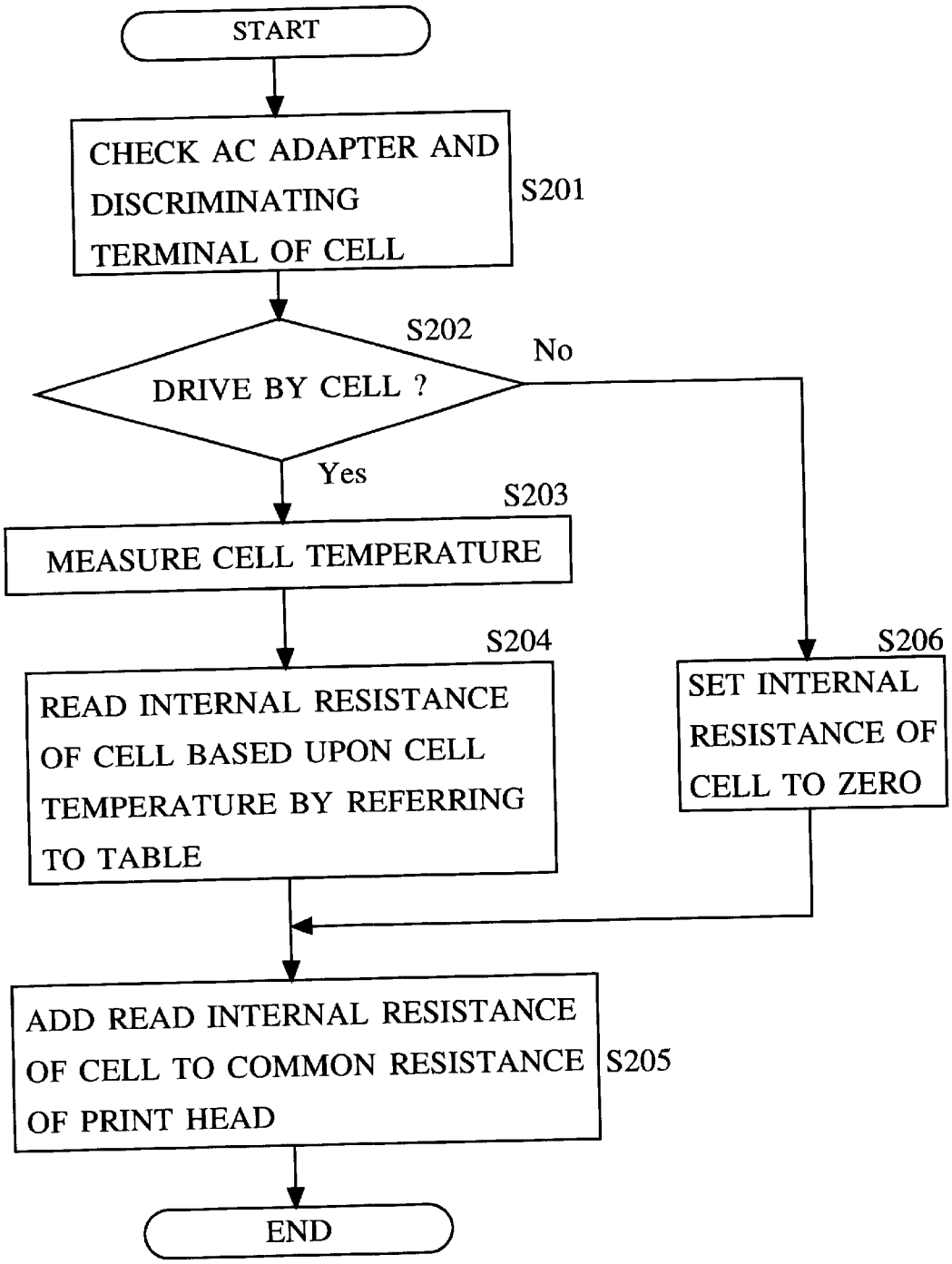
FIG. 2 is a flowchart showing the embodiment of the present invention.
Figure 3:
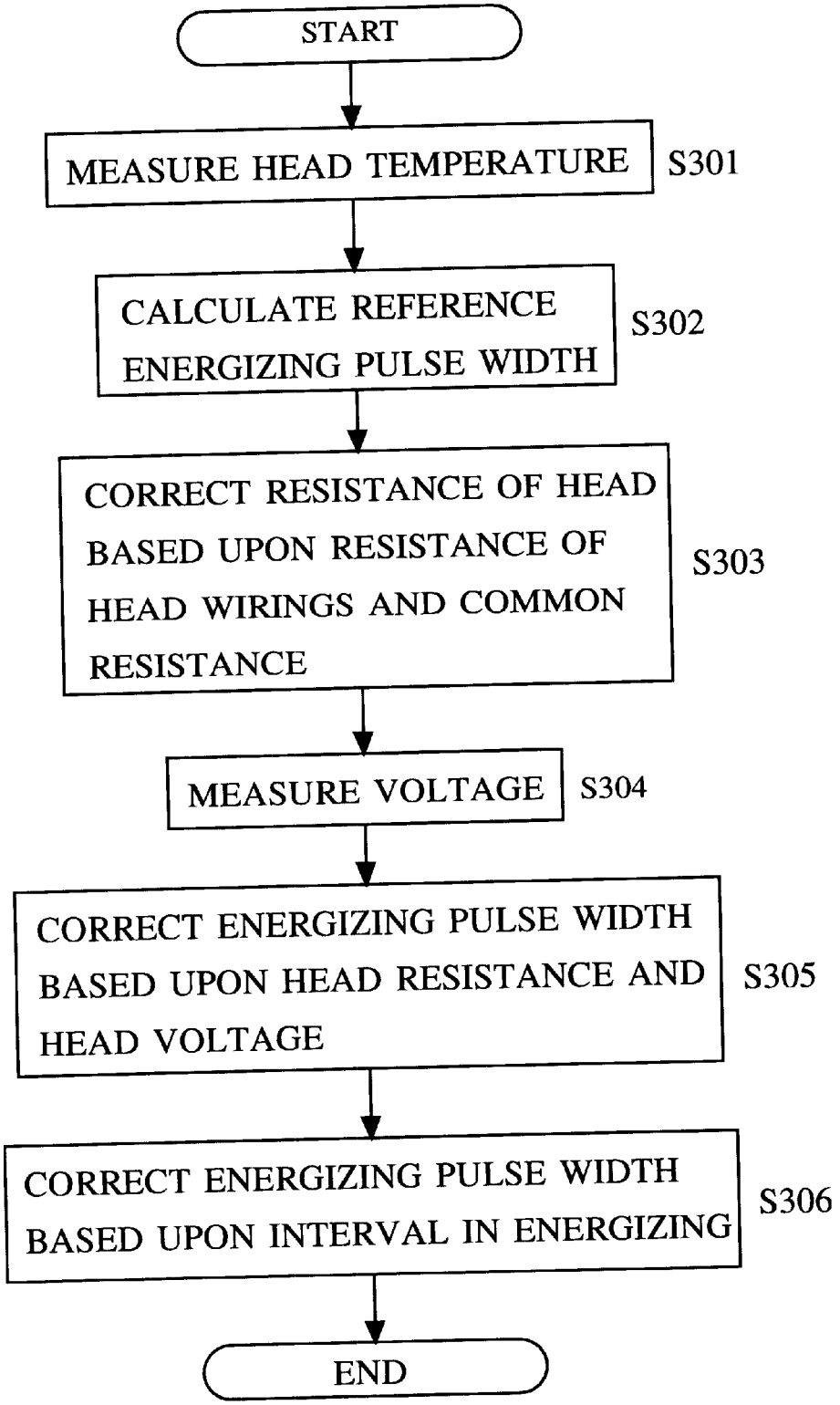
FIG. 3 is a flowchart according to the embodiment of the present invention.

FIGS. 2 and 3 are flowcharts showing the processing by the CPU 107, in which FIG. 2 shows the processing for acquiring the internal resistance of the cell 116, and FIG. 3 shows the processing for calculating the pulse width of an energizing pulse for driving each heater element of the thermal head 114. FIG. 5 shows a table stored in the ROM 108, which shows a relationship between the temperature of the cell 116 and the internal resistance.

Referring to FIGS. 1 to 3 and FIG. 5, a processing operation for inhibiting the effect of a variation in internal resistance of the cell 116 will be described below.

First, as shown in FIG. 2, it is checked and discriminated based upon a signal sent from the AC adapter/cell discriminating section 115 by which of the cell 116 or the AC adapter 117 the thermal printer is driven (steps S201 and S202). In the case where it is judged that the printer is driven by the AC adapter 117, the internal resistance of the AC adapter 117 is small, and the variation due to the temperature is also small. Accordingly, the internal resistance is set to zero so that it is a given fixed value (step S206), and is added to the common resistance of the respective heater elements that constitute the thermal head 114 (step S205). The above-mentioned common resistance is the resistance of common electrode wiring connected to the respective heater elements arranged in the thermal head 114.

In the meantime, in step S202, if it is judged that the printer is driven by the cell 116, the temperature of the cell 116 is measured by the cell temperature measuring section 103 (step S203). By referring to a table shown in FIG. 5, the internal resistance of the cell 116 is read based upon the acquired temperature of the cell (step S204). The internal resistance of the cell 116, which has been read, is added to the above-mentioned common resistance (step S205), and then the above-mentioned processing is completed.

Next, as shown in FIG. 3, the temperature of the thermal head 114 is measured with the head temperature measuring section 111 (step S301). A reference energizing pulse width that becomes a reference of an energizing pulse width for driving the thermal head 114 is calculated (step S302).

Next, the resistance of the head is corrected based upon the resistance of the wiring in the head of the respective heater elements and the above-mentioned common resistance (step S303) Voltage supplied to the thermal head 114 is measured with the head voltage measuring section 113 (step S304).

Next, the reference energizing pulse width calculated in step S302 is corrected based upon the corrected resistance of the head and the measured voltage of the head to calculate an energizing pulse width (step S305). For example, in the case where a value of the internal resistance of the cell 116 becomes larger, the above common resistance becomes larger, with the result that the resistance of the head also becomes larger. As a result, the energizing pulse width becomes longer.

Thereafter, the energizing pulse width is corrected based upon an interval in energizing (step S306) to supply to a heater element corresponding to a print signal, which is to be driven.

With this, even if the internal resistance of the cell 116 varies, printing is performed so that unevenness in density is prevented from being caused. Also, suitable printing is enabled irrespective of the number of dots (heater elements) simultaneously energized. Further, as no dummy load circuit for calculating the above internal resistance is used, the configuration becomes simple as well enabling the thermal printer to be composed at a low price and useless power is prevented from being consumed.

The above-mentioned processing may also be executed every time one line is printed. In this case, before processing step S201 shown in FIG. 2, it is judged whether the printing of one line has been completed or not, and if it is completed, the above-mentioned processing has to be executed. With this, even if the internal resistance of the cell 116 varies continuously, printing with less unevenness in density is enabled.

The thermal printer is driven by switching the cell 116 and the DC power supply (the AC adaptor 117) acquired from the AC power supply, and is configured so that it is discriminated by the AC adapter/cell discriminating section 115 by which of the cell 116 or the AC adapter 117, the thermal printer is driven. However, the AC adapter 117 and the AC adapter/cell discriminating section 115 are not necessarily required. In animate configuration, the thermal printer has only to have a configuration so that the thermal printer is driven by a power supply in which the internal resistance varies with the temperature change of the cell 116 etc.

Figure 4:
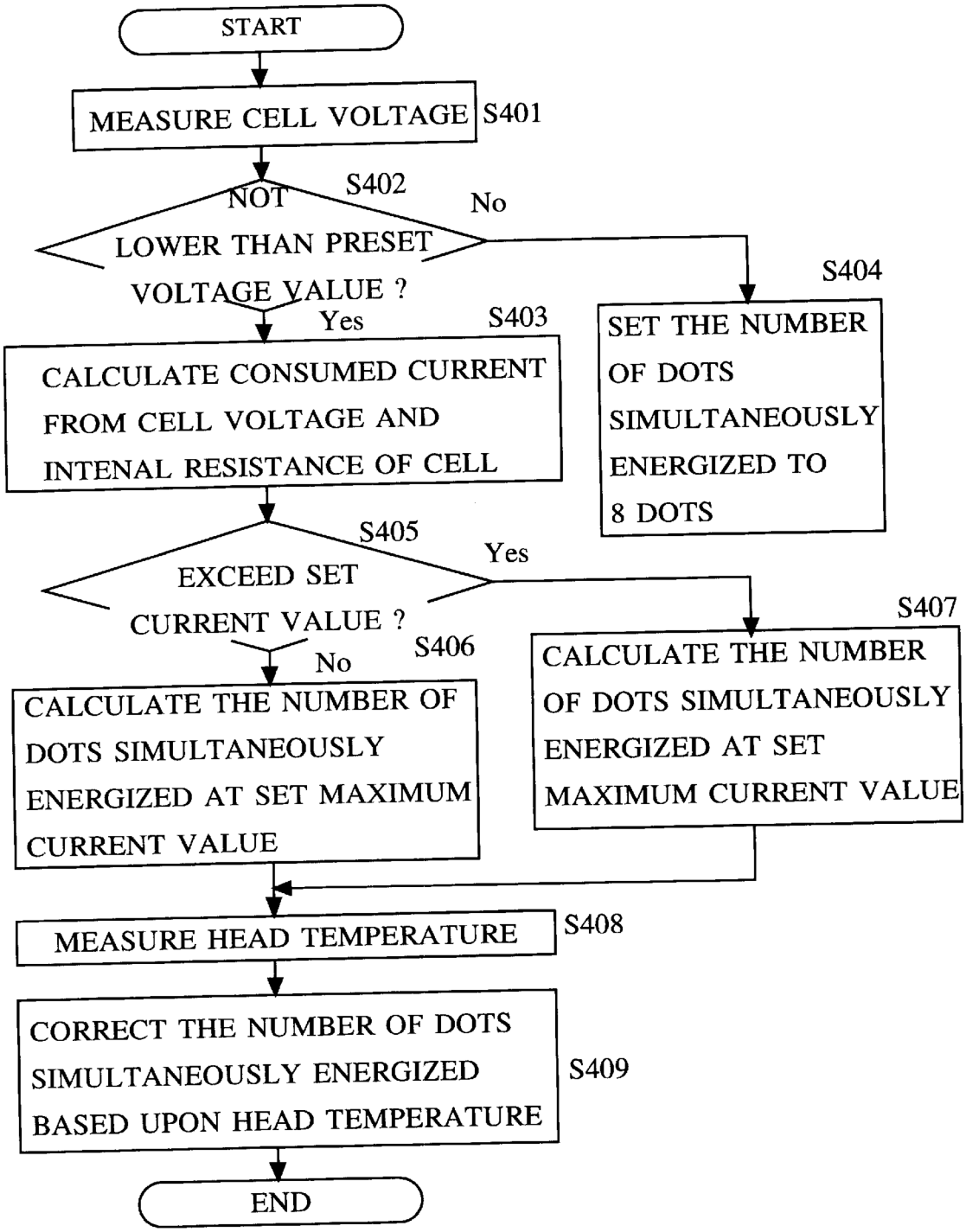
FIG. 4 is a flowchart according to the embodiment of the present invention.

FIG. 4 is a flowchart showing processing for limiting the number of heater elements simultaneously energized so that a preset maximum value of consumed current in printing is not exceeded because of the internal resistance of the cell 116, the voltage of the cell 116 and the temperature of the thermal head 114, and the voltage of the cell 116 does not become lower than a preset voltage value.

As shown in FIG. 4, the voltage of the cell 116 is measured with the cell voltage measuring section 101 (step S401). If the voltage of the above cell is smaller than the set lowest voltage, the number of heater elements simultaneously energized is limited to be set as 8 dots (step S404).

If the voltage of the cell exceeds the above lowest voltage, consumed current is calculated based upon the above voltage of the cell and the internal resistance of the cell 116 (step S403). The above-mentioned internal resistance is acquired based upon the temperature of the cell, by referring to the table shown in FIG. 5 as described above.

Next, it is judged whether or not a value of the above-mentioned consumed current exceeds a set current value (step S405). If the above-mentioned consumed current does not exceed the set current value, the number of dots (the heater elements) simultaneously energized is calculated based upon the calculated consumed current (step S406). Then, the temperature of the thermal head 114 is measured with the head temperature measuring section 111 (step S408). In the meantime, if the above-mentioned consumed current exceeds the set current value in step S405, the number of dots (the heater elements) simultaneously energized at the set maximum current value is calculated to limit consumed current (step S407), and the processing proceeds to step S408.

The number of dots simultaneously energized is corrected based upon the measured temperature of the head (step S409), and printing is executed.

If it is judged that the printer is driven by not the cell 116 but through the AC adapter 117, the internal resistance of the cell 116 is set to zero and the similar processing is executed. The maximum current value at that time is equivalent to the maximum current value of the AC adapter 117.

As described above, current consumed in printing is calculated based upon the internal resistance of the cell, and the voltage of the cell and the number of dots acquired by simultaneously energizing the heater elements is determined based upon the result so that the above-mentioned calculated consumed current does not exceed a preset maximum current value, and the voltage of the cell is not lower than a preset value of the voltage. Further, the number of dots simultaneously energized is corrected based upon the temperature of the head in printing so that the temperature of the thermal head 114 does not rise too high, and printing is executed. With this, the life of the cell can be kept long.

As described above, according to this embodiment, the thermal printer, which is driven at least by a power supply such as the cell 116 in which its internal resistance varies depend upon a temperature, and is provided with a plurality of heater elements arranged in the thermal head 114 for effecting a print by supplying an energizing pulse in accordance with a print signal to the heater element, is characterized by comprising: the cell temperature measuring section 103 for measuring a temperature of the cell 116; the ROM 108 for storing a table showing a relationship between the temperature and the internal resistance of the cell; and the CPU 107 for acquiring, by referring to a table stored in the ROM 108, a corresponding resistance on the basis of the measured temperature measured by the cell measuring section 103, and for calculating a pulse width of an energizing pulse while the resistance is taking into consideration. As a result, with a simple configuration, unevenness of printing due to temperature changes of the power source can be prevented from occurring. Further, useless power consumption can be suppressed.

Also, as the AC adapter/cell discriminating section 115 driven by switching the cell 116 and the AC adapter 117 for discriminating by which of the cell 116 or the AC adapter 117, the thermal printer is driven, is provided, and the CPU 107 is configured so that it calculates the energizing pulse width by referring to the above table if the AC adapter/cell discriminating section 115 judges that the printer is driven by the cell 116, the thermal printer driven by switching the cell 116 and the AC adapter 117 can also calculate the pulse width in case that the cell is used, and can prevent the unevenness of printing from being caused.

Further, as the CPU 107 sets the above resistance to a given fixed value and calculates the energizing pulse width in case that the AC adapter/cell discriminating section 115 judges that the printer is driven by the AC adapter 117, the pulse width can be calculated with simple configuration even if an AC adapter in which the internal resistance does not vary with the change of the temperature is used.

Furthermore, as the CPU 107 calculates the energizing pulse width every time one line is printed, printing with less unevenness of density is enabled, even if the internal resistance of the cell 116 varies every moment.

According to the present invention, the unevenness of printing can be prevented from occurring due to the temperature change of the power source with simple configuration. Also, useless power consumption can be inhibited. Further, as the energizing pulse width is calculated with the pulse width calculating means every time one line is printed, printing almost with less unevenness of density is enabled, even if the internal resistance varies every moment.

What is claimed is:

1. A thermal printer driven by a power supply having an internal resistance which varies depending upon a temperature thereof and having a plurality of heater elements arranged in a thermal head for effecting a print operation by supplying an energizing pulse in accordance with a print signal to respective heater elements, comprising:

power supply temperature measuring means for measuring a temperature of the power supply;

storing means for storing a table showing a relationship between the temperature of the power supply and the internal resistance of the power supply; and pulse width calculating means for acquiring, by referring to the table stored in the storing means, a corresponding resistance on the basis of the temperature measured by the temperature measuring means, and calculating a pulse width of an energizing pulse taking the resistance into consideration.

2. A thermal printer according to claim 1; wherein the power supply is a cell.

3. A thermal printer according to claim 2; further comprising power supply discriminating means for discriminating by which one of the cell or a DC power supply acquired from an AC power supply the thermal printer is being driven; wherein the pulse width calculating means calculates the pulse width of the energizing pulse with reference to the table only when the power supply discriminating means judges that the thermal printer is being driven by the cell.

4. A thermal printer according to claim 3; wherein the pulse width calculating means sets the resistance to a given fixed value and calculates the pulse width of the energizing pulse using the fixed value when the power supply discriminating means judges that the thermal printer is being driven by the DC power supply acquired from the AC power supply.

5. A thermal printer according to any one of claims 1, 2, 3 or 4; wherein the pulse width calculating means calculates the pulse width of the energizing pulse every time one line has been printed.

6. A printer according to claim 1; wherein the power supply comprises a battery and an AC adapter.

7. A printer according to claim 6; further comprising power supply discriminating means for determining which one of the battery and the AC adapter is being used to drive the printer; wherein the pulse width calculating means calculates the pulse width of the energizing pulse with reference to the table only when the power supply discriminating means determines that the printer is driven by the battery.

8. A thermal according to claim 7; wherein the pulse width calculating means sets the resistance to a fixed value and calculates the pulse width of the energizing pulse using the fixed value when the power supply discriminating means determines that the printer is being driven by the AC adapter.

9. A printer comprising: a print head having a plurality of printing elements for performing a printing operation in response to the application of an energizing pulse to the printing elements; a drive mechanism for causing relative movement between a paper and the print head so that the print head can print on the paper; a power supply having an internal resistance which varies depending upon a temperature; power supply temperature measuring means for measuring a temperature of the power supply; a memory for storing a table containing a relationship between the temperature of the power supply and the internal resistance of the power supply; and pulse width calculating means for determining the internal resistance of the power supply with reference to the table according to the temperature of the power supply measured by the temperature measuring means and calculating a pulse width of the energizing pulse taking the internal resistance into consideration.

10. A printer according to claim 9; wherein the print head is a thermal print head and the printing elements comprise resistive heating elements.

11. A printer according to claim 9; wherein the pulse width calculating means further comprises means for correcting the calculated value of the energizing pulse based on a temperature of the print head.

12. A printer according to claim 9; wherein the drive mechanism comprises a stepper motor for moving the paper with respect to the print head.

13. A method for limiting the number of printing elements that can be simultaneously energized to conduct a printing operation in a print head having a plurality of printing elements of a battery-powered printer so that a predetermined maximum consumed current value is not exceeded during the printing operation, comprising the steps of:

measuring a voltage and an internal resistance of the battery;

calculating a consumed current in a printing operation to be performed based on the measured voltage and internal resistance of the battery; and calculating the maximum number of printing elements that can be simultaneously energized during the printing operation based on the calculated consumed current.

14. A method according to claim 13; further comprising the steps of measuring the temperature of the print head, and correcting the calculated maximum number of printing elements that can be simultaneously energized during the printing operation so that the temperature of the print head does not rise above a desired value during the print operation.

15. A method according to claim 13; further comprising the step of setting maximum number of printing elements that may be simultaneously energized during the printing operation to a preset value if the calculated consumed current exceeds a predetermined value.

* * * * *